United States Patent [19]

Gaspar et al.

[11] Patent Number: 5,040,594

[45] **Date of Patent: * Aug. 20, 1991**

[54] SIDE FEED TUNDISH APPARATUS AND METHOD FOR THE ALLOYING AND RAPID SOLIDIFICATION OF MOLTEN MATERIALS

[75] Inventors: Thomas Gaspar, Bexley; Lloyd E. Hackman, Worthington, both of Ohio

[73] Assignee: Ribbon Technology Corporation, Gahanna, Ohio

[ * ] The portion of the term of this patent subsequent to Aug. 20, 2008, has been disclaimed.

[21] Appl. No.: 375,148

[22] Filed: Jul. 3, 1989

Related U.S. Application Data

[63] Continuation-in-part of Ser. No. 364,231, Jun. 12, 1989.

[51] Int. Cl.[5] ..... B22D 11/06; B22D 41/00

[52] U.S. Cl. ..... 164/463; 164/423; 164/429; 164/437; 164/479; 164/488; 164/489; 222/590; 222/591

[58] Field of Search ..... 164/463, 479, 488, 489, 164/423, 429, 437; 222/590, 591, 594

[56] References Cited

U.S. PATENT DOCUMENTS

| | | | |
|---|---|---|---|
| 993,904 | 5/1911 | Strange | 164/429 |
| 4,326,579 | 4/1982 | Pond, Sr. et al. | 164/463 X |
| 4,485,839 | 12/1984 | Ward | 164/463 |
| 4,540,546 | 9/1985 | Giessen | 164/463 X |
| 4,582,116 | 4/1986 | Ray et al. | 164/479 X |
| 4,890,662 | 1/1990 | Sanchez-Caldera et al. | 164/463 X |
| 4,928,748 | 5/1990 | Guthrie et al. | 164/488 X |

FOREIGN PATENT DOCUMENTS

| | | | |
|---|---|---|---|
| 60-174239 | 9/1985 | Japan | 164/463 |
| 1020182 | 5/1983 | U.S.S.R. | 164/437 |
| 15548 | 7/1914 | United Kingdom | 164/429 |

*Primary Examiner*—J. Reed Batten, Jr.
*Attorney, Agent, or Firm*—Frank H. Foster

[57] ABSTRACT

The flow control of molten alloy material in a tundish is improved by the design of a perpendicular turn in the path of flow of the molten alloy material as the flow leaves an intermediate section of the tundish or casting receptacle and overflows transversely an exit lip to thereby contact a heat-extracting substrate. The perpendicular turn in the flow achieves improved control of the molten alloy material's velocity profile, cooling rate, and depth and flow uniformity of the molten alloy material in the casting receptacle. The essentially perpendicular turn in the path of the molten alloy material from the intermediate section causes the molten alloy material to approach the exit lip in a transverse direction unlike conventional laminar or direct delivery molten flow. The transverse flow relative to the direction of the exit over-flow toward the casting or cooling surface facilitates improved mixing of the molten alloy material, improved control of the depth gradient, and improved control of the velocity into the exit lip.

12 Claims, 2 Drawing Sheets

SIDE FEED TUNDISH APPARATUS AND METHOD FOR THE ALLOYING AND RAPID SOLIDIFICATION OF MOLTEN MATERIALS

CROSS REFERENCE TO RELATED APPLICATION

This invention is a continuation-in-part of patent application serial number 07/364,231 filed on June 12, 1989 by Gaspar and assigned to the assignee of this invention, the disclosure of which is incorporated herein by reference.

TECHNICAL FIELD

This invention relates generally to an improved method and apparatus for preparing ribbon, filaments, fiber, or film alloy from molten materials by moving a surface of a substrate past a region of contact with a mixture of molten alloy material and removing it from the substrate. More specifically, the invention relates to a method for alloying two or more metals in a sidefeed tundish whereby a uniform flow of molten alloy material is obtained across the width of the region of contact between the molten alloy material and the surface of the moving substrate.

BACKGROUND OF THE INVENTION

In conventional alloying of metal ribbon, filaments, fiber, or film it is often difficult to obtain and/or maintain a uniform mixture of molten alloy material across the exit or pouring lip of a pouring vessel onto the surface of a heat-extracting substrate. This difficulty is due to, among other factors, non-uniform cooling of the metal or metals in various parts of the pouring vessel, or to non-uniform mixing of the metals in the formation of the molten alloy material, or to non-uniform velocity of the molten alloy material as it flows through the pouring vessel toward the pouring lip.

Various systems have been employed to attempt to avoid these problems. For example, U.S. Pat. No. 4,678,719, issued on July 7, 1987 to Johns et al. and assigned to Allegheny Ludlum Corporation, teaches a widening tundish in an attempt to control the velocity profile of the flow of molten material to thereby aid strip casting of crystalline metal. However, additional baffles and weirs are needed to further control the velocity profile toward the cooling substrate and/or to control the depth across the width of the tundish. Furthermore, the design of Johns et al. provides only laminar flow or direct delivery of the molten flow to the casting or cooling surface. This can result in non-uniform delivery rate across the surface of the cooling substrate. Johns et al. is not directed to alloying of molten materials.

Hackman et al., in U.S. Pat. No. 4,813,472, issued Mar. 21, 1989 teaches an improved method for producing filaments or fiber from a molten material by overflowing the molten material against the surface of a rotating cooling substrate. Hackman et al. is not directed to alloying of molten materials.

Also known are orifice-type casting systems wherein molten material is delivered from a nozzle to the quenching or casting surface. However, poor quality can result from such casting systems due to non-uniform cooling, partial shrinkage of the strip, and the development of cracks in the strip.

In addition, orifice-type extrusion systems suffer from relative complexity of the necsesary process control systems and the difficulty in passing a molten material through fixed, small orifices. The orifice must be constructed from an exotic material if the molten material has a relatively high melting point. The orifices have a tendency to erode and/or become partially or completely blocked due to the freezing of material on the orifice.

Conventional alloying processes generally require the premixing of the materials to be alloyed before the molten alloy material is poured into the tundish apparatus. In this manner, it is often difficult to achieve and maintain even distribution of one molten component in the other molten component. It is also difficult to determine whether the heavier or the higher-melting of the materials to be alloyed is still molten and/or dispersed in the lighter or lower-melting of the materials.

Thus a method and apparatus are desirable which are suitable for commercial production of metal alloy at reduced cost and with improved control of the molten alloy material flow. It is an object of the present invention to provide a method and an apparatus for improved alloying of metal strip, which method is superior to known alloying and casting processes.

Another object of the present invention is to provide a system for forming ribbon, filaments, fiber, or film metal alloy products directly from a mixture of molten alloy materials in a manner whereby the mixing is improved and the depth, cooling rate, wetting of the exit lip, and velocity of the molten alloy material flowing toward a cooling substrate are also controlled.

SUMMARY OF THE INVENTION

In accordance with the present invention, a method is provided for directly alloying and casting molten material to continuous strip, fiber, filament, or ribbon. The present invention relates to an improved design of a tundish or casting receptacle, whereby a uniform flow of molten alloy material or materials is obtained across the width of the region of contact between the molten alloy material and the surface of a moving and cooling substrate. By the present invention, the control of the velocity profile, cooling rate, and depth uniformity of the molten alloy material in the casting receptacle are improved.

By "molten alloy material" herein is meant any two or more melted or flowable metals, metal alloys, or ceramic materials, which have been essentially homogeneously mixed.

By "tundish" herein is meant any tundish, casting receptacle, melting reservoir, vessel, container, or other receiver or conveyor of molten material.

The alloying process of the present invention is achieved by mixing directly in the tundish two or more melted or flowable metals, metal alloys, or ceramic materials to form a molten alloy material. The process of the present invention is further enhanced by designing into the tundish apparatus an essentially perpendicular turn in the path of the flow of the molten alloy material from the intermediate section of a casting receptacle before the molten alloy material is exposed to a cooling substrate. The improvement is enhanced according to the present invention by supplying two or more opposing feeding sources to the intermediate section of a casting receptacle, whereby uniform mixing and overflowing of an exit lip of the receptacle is obtained. The essentially perpendicular turn in the path of the molten alloy materials causes the molten alloy material to approach the exit lip in a transverse direction unlike conventional laminar or direct delivery molten flow. The transverse flows, relative to the direction of the exit overflow toward the casting or cooling surface, facilitate surprisingly improved mixing of the molten materials, improved control of the depth gradient, and improved control of the velocity into the exit lip. The improved mixing which is produced as a result of the essentially perpendicular turn or turns in the flow paths of the molten materials facilitates improved alloying of the two or more materials in the tundish. The transverse flow relative to the direction of the exit overflow toward the casting or cooling surface also facilitates faster wetting of the exit lip and more uniform wetting of the cooling substrate. In this manner, solidified alloy strip can be pulled almost immediately from the receptacle containing the mixed molten alloy material.

DETAILED DESCRIPTION OF THE INVENTION

Figure 1:
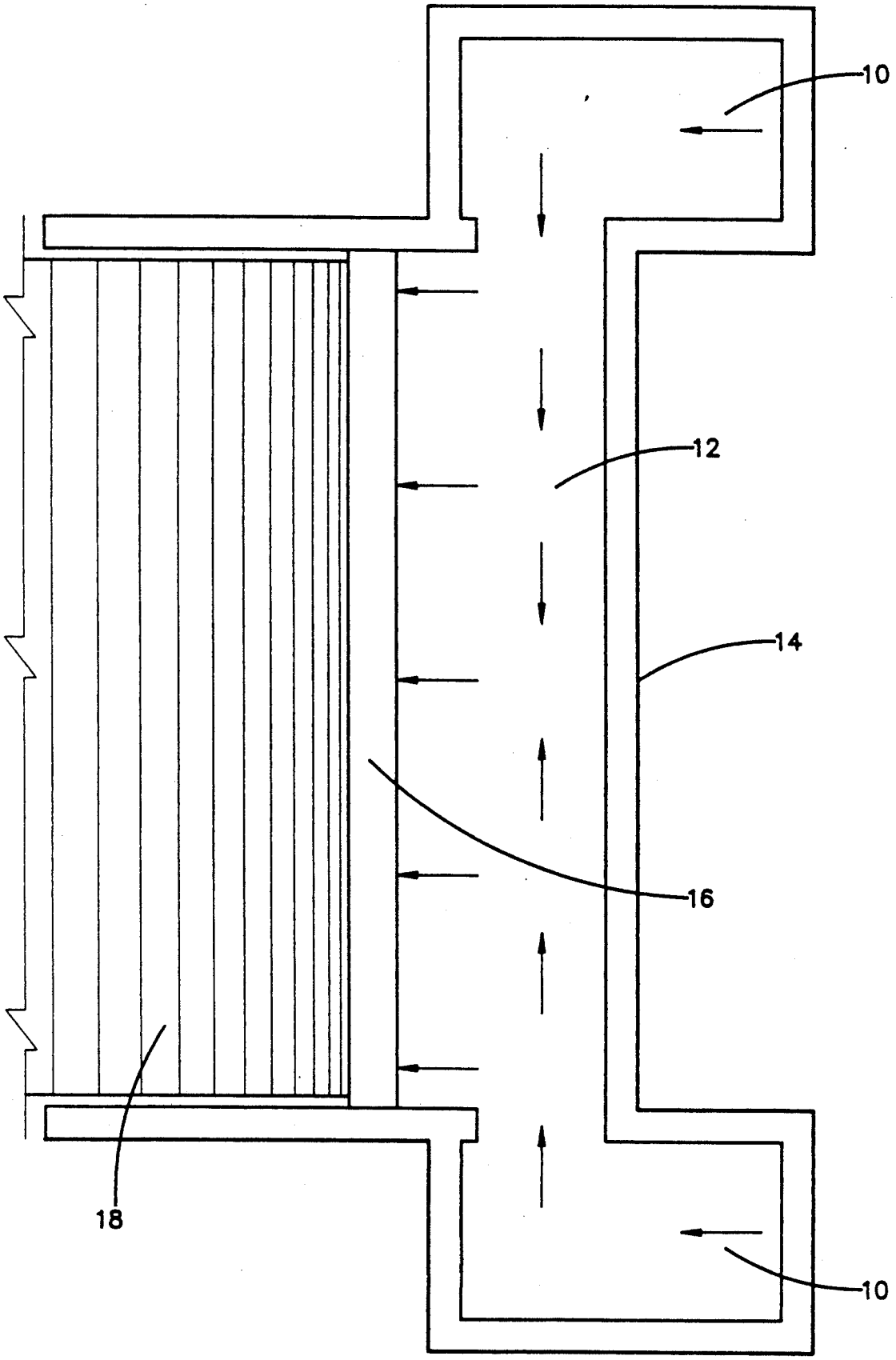
FIG. 1 is a top plan view of a dual side feed alloy melt overflow tundish apparatus.

FIG. 1 illustrates a dual side feed alloy melt overflow tundish apparatus possessing two laterally displaced side feeding sources 10 into which the two different molten materials are fed. A continual supply of fresh molten material may be delivered to the rear of each of the side feeding sources 10 at a controlled rate by a conventional means such as a ladle, funnel, or submerged nozzle. In one embodiment, the molten materials preferably flow within the side feeding sources 10 in the general direction of the chilled roll moving substrate 18 but on a path within the feeding sources laterally displaced therefrom. The molten materials will preferably, but not necessarily, then negotiate an essentially perpendicular turn so as to enter the intermediate section 12 of the casting receptacle 14. However, the feeding sources 10 need not be perpendicular to the end of the intermediate section 12 but rather can extend outwardly from the intermediate section 12. The molten materials which flow from the two side feeding sources 10 meet and mix in or near the center of the intermediate section 12 of the casting receptacle 14. The mixing which occurs in the intermediate section is sufficient to produce a molten alloy material. The mixed molten alloy material is then allowed to transversely overflow the exit lip 16 onto the chilled roll moving substrate 18 which is cold enough to cause the molten alloy material to at least partially solidify.

Figure 2:
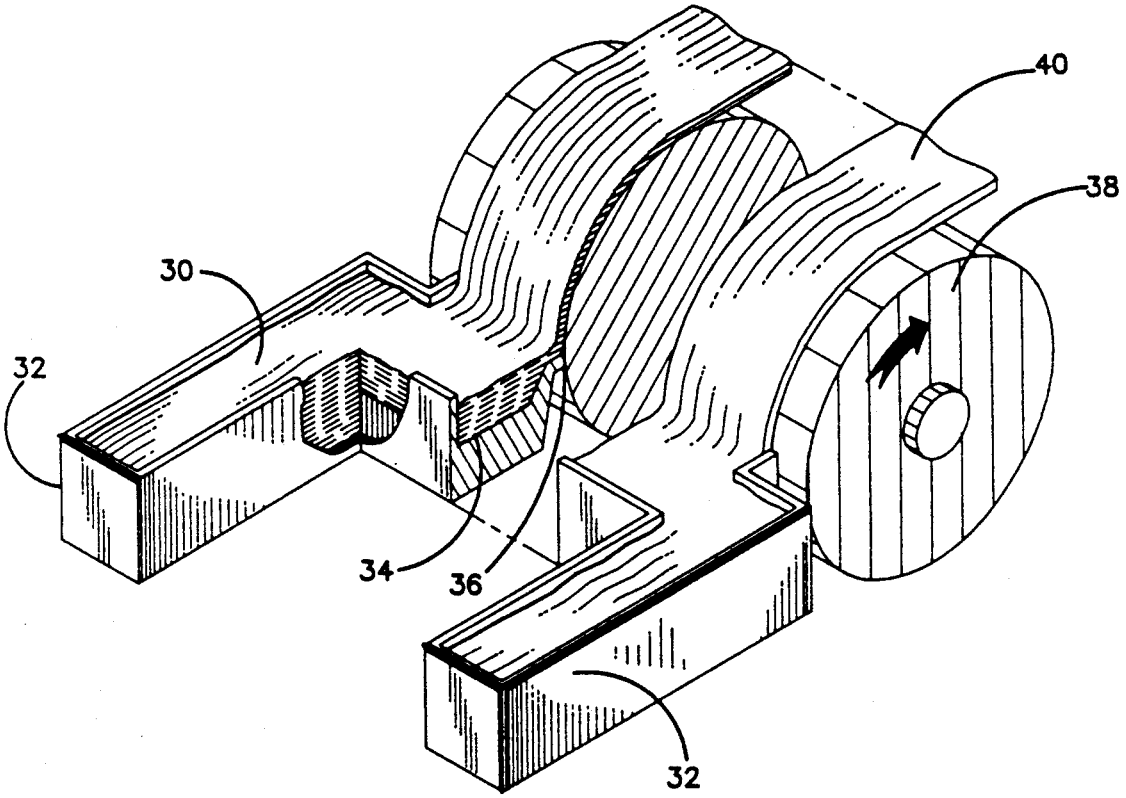
FIG. 2 is a diagrammatic illustration of the dual side feed alloy melt overflow tundish embodiment shown in FIG. 1.

FIG. 2 illustrates a similar receptacle with two laterally displaced side feeding sources 32 into which the molten material 30 is dropped or fed from, for example, a nozzle or funnel. The molten material 30 can flow in the general direction of the chilled roll moving substrate 38 but on a path within the side feeding sources 32 laterally displaced therefrom. However, as described above, the side feeding sources 32 need not be perpendicular to the intermediate section 34 but can extend outwardly therefrom. The molten material is preferably but not by limitation herein caused to turn essentially 90° to enter the intermediate section 34 of the casting receptacle. The molten materials from the two side feeding sources 32 meet and mix in or near the center of the intermediate section 34 to produce a molten alloy material. The mixed molten alloy material is allowed to overflow the exit lip 36 to thereby contact and flow over the chilled roll moving substrate 38. The mixed molten alloy material thereby at least partially solidifies to form an alloy ribbon, filament, fiber, or film.

As illustrated in FIG. 2 and applicable to all embodiments of the invention, the substrate 38 is moved along a region of contact or a melt front positioned at an edge of the upper surface of the molten alloy material 30. The substrate 38 moves generally transversely or obliquely to the plane of the molten alloy material surface. The layer of molten alloy material which contacts the substrate 38 is carried upwardly away from the molten alloy material for cooling and removal from the substrate 38.

The significant feature of the present invention is the shape of the receptacle or casting vessel, often called a tundish, and the dual side feeding sources which convey the molten materials to the intermediate section of the tundish and thence to the exit lip. The alloying process improvement of the present invention is enhanced, according to one embodiment of the present invention, by designing an optional essentially perpendicular turn in the paths of the flow of the molten materials from the lateral feeding sources into an intermediate section of the casting receptacle, and a required essentially perpendicular turn in the flow from the intermediate section toward the exit lip whereby uniform and thorough mixing is achieved before the exit lip is encountered. The mixing which results is sufficient to facilitate alloying of the different molten materials. By the apparatus and method of the present invention, the molten alloy thus produced can be overflowed out of or over the tundish exit lip into contact with the cooling substrate. The essentially perpendicular turn in the path of flow of the mixed molten materials from the lateral feeding sources into the intermediate section of the tundish is preferred but not required and causes the two molten materials to approach the exit lip from each side feeding source in a direction transverse to the eventual exit overflow, unlike conventional laminar or direct delivery molten flow. This transverse approach relative to the exit lip reduces the velocity profile of the molten materials in the direction of the exit lip to essentially zero, while not sacrificing the mixing or alloying, nor allowing the molten materials or molten alloy material to stand, and thus solidify, in the casting receptacle.

Furthermore, by the present invention the path of delivery of the molten alloy materials after the optional 90 degree turn from the side feeding sources to the intermediate section of the tundish is further altered by the change in direction of the flow of the molten alloy material as it is caused to overflow transversely the exit lip. In this manner another essentially 90 degree turn in the flow of the molten materials is required for the molten alloy material to encounter the exit lip and thereafter the cooling substrate. This additional 90 degree turn occurs in the direction in which the molten alloy material has essentially zero velocity vector. The molten alloy materials in this portion of the casting receptacle or tundish are presented to the chill block or cooling substrate as a static, quiescent, uniform yet well mixed alloy or blend across the lip of the tundish. The side feeding produces a surprisingly smooth, calm, and steady yet well mixed pool of molten alloy material to be delivered to the exit lip. This feature of the present invention also helps to improve control in the uniformity of the molten alloy material depth across, and flow toward, the exit lip, as well as the ability to alloy the materials within the tundish.

The method and apparatus of the present invention are best exemplified by a tundish, which includes an upper, generally horizontal edge or lip which is relatively lower than the top of the receptacle. A first molten material, such as a metal or ceramic material, is fed from one or more laterally displaced feeding sources into the intermediate section of the receptacle. A second molten material such as a metal or ceramic material, is fed from one or more second laterally displaced feeding sources into the intermediate section of the receptacle. The two molten materials are added to, and allowed to mix and form an alloy in, the intermediate section of the receptacle. The two molten materials are added to a level such that the mixture of molten alloy material produced overflows the edge, also referred herein as the exit lip. The laterally displaced feeding sources may be deeper than, equal to, or shallower than the intermediate section of the tundish.

A movably mounted heat extracting substrate is spaced from the exit edge or lip of the tundish and mounted to be contacted by the overflowed molten alloy material substantially at the level of the upper surface of the molten material.

The moving substrate surface can be effectively substituted for a portion of the container wall which is absent above the substantially horizontal edge. The molten alloy material flow, after negotiating the optional essentially perpendicular turn from the feeding source and the essentially perpendicular turn from the intermediate section, is overflowed or poured against that substrate surface.

Thus the present invention also relates to an improved method for producing an alloy material of ribbon, filaments, fiber, or film from two or more molten materials, said method being the type wherein a layer of said molten alloy material is solidified on a heat-extracting substrate by moving a surface of the substrate past a region of contact with the molten alloy material, cooling the molten alloy material and removing it from the substrate, wherein the method comprises:

(a) supplying two or more molten materials to two or more opposing feeding ends of a substantially horizontal casting receptacle, wherein the feeding ends are adjacent to, contiguous with, and essentially laterally beside a substantially horizontal intermediate section of the casting receptacle, wherein said intermediate section of the casting receptacle has an exit lip which is adjacent to a moving substrate;

(b) causing the molten materials to flow through the opposing feeding ends, optionally through an essentially 90 degree angle, and into said intermediate section of said casting receptacle, whereby mixing of the molten materials from the opposing feeding ends sufficient to alloy the materials occurs in said intermediate section;

(c) allowing the mixed molten alloy material of step (b) to overflow said exit lip of said intermediate section of the casting receptacle, whereby a uniform flow of molten alloy material is obtained across the width of the exit lip, and whereby the direction of flow of the molten alloy material from the intermediate section of the receptacle to the exit lip is essentially perpendicular to the flows entering the intermediate section from the opposing lateral feeding ends; and, (d) contacting the molten alloy material at the exit lip of the casting receptacle with the surface of the moving substrate, whereby the molten alloy material at least partially solidifies in the form of ribbon, filaments, fiber, or film, depending on the surface geometry of the substrate.

The directions of the flows of the feeds are preferably from opposite sides of the intermediate section of the casting receptacle, whereby the flows are opposing each other and are each transverse to the overflow from the exit lip onto the moving and/or cooling substrate.

The molten materials which can be used in the above embodiments include metals, blends, alloys, mixtures, and the like. The metals can include but are not limited to iron, steel, titanium, tantalum, niobium, tungsten, molybdenum, copper, cobalt, zinc, lead, nickel, gold, silver, platinum, magnesium, silicon, and aluminum and alloys and mixtures thereof.

The casting receptacle of the present invention can be lined with or produced from, for example, a ceramic refractory material or graphite. However, this is not a limitation of the present invention. It is only required herein that the tundish or its lining or both be made of a material with a melting point higher than that of the molten material. When used in the present invention, the lining or mat acts as a heat extracting medium causing solidification of a skull of material which acts to protect the remaining molten materials or the molten alloy material from contamination by or from the surfaces of the receptacle.

In the operation of the present invention, a nozzle or opening from a ladle or funnel or receptacle feeding into the tundish is preferred. The nozzle serves to control or meter the molten material flow into the side feeding sources of the tundish. The nozzle can be an annular nozzle and can be positioned so as to drop the molten materials from some predetermined height into the side feeding sources of the tundish. Alternatively, the nozzle can be positioned such that the nozzle opening is submerged beneath the surface level of the molten material within the side feeding sources of the tundish. It has been discovered that the side feeding tundish alloying performance can thus be improved by the metering effect of the nozzle or orifice.

While certain preferred embodiments of the present invention have been disclosed in detail, it is to be understood that various modifications in its structure may be adopted without departing from the spirit of the invention or the scope of the following claims.

That which is claimed is:

1. A method for alloying two or more materials in a tundish, said method being the type wherein a layer of molten alloy material is solidified on a heat-extracting substrate by overflowing the molten material over an exit lip onto a surface of the substrate which is moving upwardly past a region of contact with an edge of the upper surface of the molten alloy material, cooling the molten alloy material and removing it from the substrate, wherein the method comprises the steps of:

(a) supplying two or more different molten materials to two or more feeding ends of a casting receptacle, wherein the feeding ends are adjacent to, contiguous with, and essentially laterally beside a substantially horizontal intermediate section of the casting receptacle, wherein said intermediate section of the casting receptacle has an exit end which is adjacent to said moving substrate and wherein the upper surface of the molten material in said feeding ends is a continuous, substantially coplanar extension of the upper surface of the molten material in said casting receptacle;

(b) causing the molten materials to flow through the feeding ends into said intermediate section of said casting receptacle, where mixing of the molten materials from the feeding ends sufficient to alloy the materials occurs to produce a molten alloy material;

(c) allowing the molten alloy material to overflow said exit end of said intermediate section of the casting receptacle, whereby a uniform depth of said molten alloy material is obtained across the width of the exit end; and, (d) contacting the molten alloy material at the exit end of the casting receptacle with the surface of the moving substrate, whereby the molten alloy material at least partially solidifies in the form of ribbon, filaments, fiber, or film.

2. The method of claim 1 wherein the casting receptacle is heat extracting, whereby at least some of the molten alloy material freezes to form a thin skull on the surfaces of the receptacle, whereby additional molten materials and molten alloy material are not contaminated by said surfaces.

3. The method of claim 1, wherein the molten materials are independently selected from the group consisting of metals, ceramic materials, metal alloys, and mixtures thereof.

4. The method of claim 3, wherein the molten material is a metal selected from the group consisting of iron, steel, titanium, niobium, tantalum, molybdenum, tungsten, copper, cobalt, zinc, lead, nickel, gold, silver, platinum, magnesium, silicon, aluminum, and alloys thereof.

5. The method of claim 4 wherein the molten material comprises titanium.

6. The method of claim 1 wherein there are two opposing feeding sources, whereby the directions of the flows of the molten materials are from opposite sides of the intermediate section of the casting receptacle, whereby the flows from the feeding sources are opposing each other and are each transverse to the overflow from the exit end onto the moving substrate.

7. The method of claim 6 wherein each molten material is independently selected from the group consisting of metals, ceramic materials, and metal alloys.

8. The method of claim 7 wherein the molten material is a metal selected from the group consisting of iron, steel, titanium, niobium, tantalum, molybdenum, tungsten, copper, cobalt, zinc, lead, nickel, gold, silver, platinum, magnesium, silicon, aluminum and alloys thereof.

9. A dual-side feed tundish apparatus for producing ribbon, filaments, fiber, or film from a molten alloy material, the apparatus comprising:

(a) a casting receptacle for containing molten material, said receptacle comprising (i) an intermediate essentially horizontal section for confining the molten material on its sides and bottom but permitting the formation of an unconfined upper surface, (ii) two or more opposing side feeding sources from which molten materials are fed into opposing sides of the intermediate horizontal section, wherein the feeding sources are adjacent to, contiguous with, and essentially laterally beside said intermediate section of said receptacle to confine the molten materials in the side feeding sources with an upper surface which is substantially a continuous coplanar extension of the upper surface of the molten materials in said intermediate horizontal section, and (iii) an exit lip located between the opposing feeding ends;

(b) a movably mounted, heat extracting substrate spaced from the exit lip of the receptacle and mounted to be contacted by overflowed molten alloy material at the level of the exit lip of the receptacle; and (c) means for continuously moving the surface of said substrate past a region of its contact with said molten alloy material.

10. An apparatus in accordance with claim 9 wherein said substrate is a rotating, generally cylindrical drum or wheel.

11. An apparatus in accordance with claim 9 wherein said casting receptacle comprises a refractory ceramic material.

12. An apparatus in accordance with claim 9 wherein said casting receptacle comprises graphite.

* * * * *